US009945524B2

(12) United States Patent
Jimbo et al.

(10) Patent No.: US 9,945,524 B2
(45) Date of Patent: Apr. 17, 2018

(54) LIGHT SOURCE UNIT AND LIGHTING FIXTURE

(71) Applicant: Panasonic Intellectual Property Management Co., Ltd., Osaka (JP)

(72) Inventors: Yukihiro Jimbo, Osaka (JP); Toru Mizotani, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/203,353

(22) Filed: Jul. 6, 2016

(65) Prior Publication Data

US 2017/0009946 A1 Jan. 12, 2017

(30) Foreign Application Priority Data

Jul. 6, 2015 (JP) ..... 2015-135518

(51) Int. Cl.

| | |
|---|---|
| ***F21S 4/00*** | (2016.01) |
| ***F21S 8/04*** | (2006.01) |
| ***F21V 3/02*** | (2006.01) |
| ***F21V 5/00*** | (2018.01) |
| ***F21V 17/10*** | (2006.01) |
| ***F21V 23/02*** | (2006.01) |
| ***F21V 23/06*** | (2006.01) |
| ***F21V 15/015*** | (2006.01) |
| ***F21S 4/28*** | (2016.01) |
| ***F21V 17/04*** | (2006.01) |
| ***F21V 17/06*** | (2006.01) |

(52) U.S. Cl.

CPC ..... *F21S 8/043* (2013.01); *F21S 4/28* (2016.01); *F21V 3/02* (2013.01); *F21V 5/00* (2013.01); *F21V 15/015* (2013.01); *F21V 17/04* (2013.01); *F21V 17/06* (2013.01); *F21V 17/101* (2013.01); *F21V 23/02* (2013.01); *F21V 23/06* (2013.01)

(58) Field of Classification Search

CPC ..... F21S 4/28; F21V 17/04; F21V 17/06

USPC ..... 362/223

See application file for complete search history.

(56) References Cited

U.S. PATENT DOCUMENTS

2015/0159848 A1* 6/2015 Sieberth ..... F21V 23/06 362/311.02

FOREIGN PATENT DOCUMENTS

| | | | |
|---|---|---|---|
| JP | 2010-080372 | A | 4/2010 |
| JP | 2012-079600 | A | 4/2012 |
| JP | 2012-199503 | A | 10/2012 |
| JP | 2013-251141 | A | 12/2013 |

(Continued)

*Primary Examiner* — Sean Gramling

(74) *Attorney, Agent, or Firm* — McDermott Will & Emery LLP

(57) ABSTRACT

A light source unit includes an attachment body including an attachment board, a circuit board having a first surface in contact with the attachment board and a second surface on which lighting sources are mounted. The light source unit further includes a cover attached to the attachment body so as to cover the second surface of the circuit board. The cover includes a panel covering the circuit board and a pair of inner flanges each of which extending from both ends of the panel in a width direction of the panel so as to come toward each other. The circuit board is supported by being held between the pair of inner flanges and the attachment board of the attachment body.

16 Claims, 6 Drawing Sheets

(56) References Cited

FOREIGN PATENT DOCUMENTS

| | | | |
|---|---|---|---|
| JP | 2014-116299 | A | 6/2014 |
| JP | 2014-179207 | A | 9/2014 |

* cited by examiner

LIGHT SOURCE UNIT AND LIGHTING FIXTURE

CROSS-REFERENCE TO RELATED APPLICATION

The application is based upon and claims the benefit of priority of Japanese Patent Application No. 2015-135518, filed on Jul. 6, 2015, the entire contents of which are incorporated herein by reference.

TECHNICAL FIELD

The present disclosure generally relates to light source units and lighting fixtures using the same, and more specifically to a light source unit having an elongated shape and a lighting fixture using the same.

BACKGROUND ART

Document 1 [JP 2014-116299 A] discloses an example of a conventional light source unit and a lighting fixture. The lighting fixture disclosed in Document 1 is a ceiling direct mounted lighting fixture, and includes a fixture body to be installed on a ceiling using hanger bolts, and a light source unit which is detachably attached to the fixture body.

The light source unit includes plural circuit boards, an attachment body to which the circuit boards are attached, and a cover attached to the attachment body so as to cover the circuit boards. The attachment body has plural suspending parts arranged along a forward and rearward direction on both sides in a left and right direction. The circuit board is mounted on a base surface of the attachment body, and is held by the suspending parts from the left and right direction. Specifically, each of the suspending parts is formed by cutting and raising a part of the base surface. Each of the suspending parts is bent toward the inside of the attachment body to have a tip side, so that the attachment body holds the circuit board between the tip sides of the suspending parts and the base surface.

Incidentally, because the light source unit and the lighting fixture of Document 1 have the suspending parts, openings are made in the attachment body. Therefore, the light source unit and the lighting fixture having the suspending parts have a concern that the dusts and bugs may enter the inside of the cover through the openings. Then, operators had to seal the openings with tapes in the manufacture process in order to prevent dusts and bugs from entering the inside of the cover.

SUMMARY

The present technology has been achieved in view of the above circumstance, and object thereof is to provide a light source unit and a lighting fixture, capable of reducing steps of manufacture process and preventing dusts, bugs, and others from entering the inside of the cover.

A light source unit of an aspect in accordance with the present disclosure includes an attachment body having an elongated shape, which has a longer side in a length direction and a shorter side in a width direction shorter than the longer side, and including an attachment board; a circuit board having a first surface in contact with the attachment board and a second surface on which lighting sources are mounted. The light source unit further includes a cover having an elongated shape, which has a longer side in a length direction and a shorter side in a width direction shorter than the longer side, and attached to the attachment body so as to cover the second surface of the circuit board with the length direction of the cover being in parallel to the length direction of the attachment body. The cover includes a panel having an elongated shape, which has a longer side in a length direction and a shorter side in a width direction shorter than the longer side, and covering the circuit board, and a pair of inner flanges each of which has a board shape and which extend from both ends of the panel in the width direction of the panel so as to come toward each other. The circuit board is supported by being held between the pair of inner flanges and the attachment board of the attachment body.

A lighting fixture of an aspect in accordance with the present disclosure includes the light source unit and a fixture body to which the light source unit is to be attached.

BRIEF DESCRIPTION OF THE DRAWINGS

Preferred embodiment of the disclosure will now be described in further details. Other features and advantages will become better understood with regard to the following detailed description and accompanying drawings where.

DETAILED DESCRIPTION

Hereinafter, a light source unit 2 and a lighting fixture 100 according to an embodiment of the present disclosure are described in details with reference to drawings. In the following embodiment, a lighting fixture 100 mounted directly on a ceiling material 300 (refer to FIG. 2A) and a light source unit 2 used in the lighting fixture 100, are explained as examples. However, the technical concept of the present disclosure may be applied to a lighting fixture 100 not directly mounted on the ceiling material 300 and a light source unit 2 used in the lighting fixture 100, or a lighting fixture 100 mounted on a place other than the ceiling material 300 and a light source unit 2 used in the lighting fixture 100. Note that, unless otherwise noted, the following explanation is made based on a forward and rearward direction, a left and right direction, and an upward and downward direction shown in FIG. 1.

Figure 1:
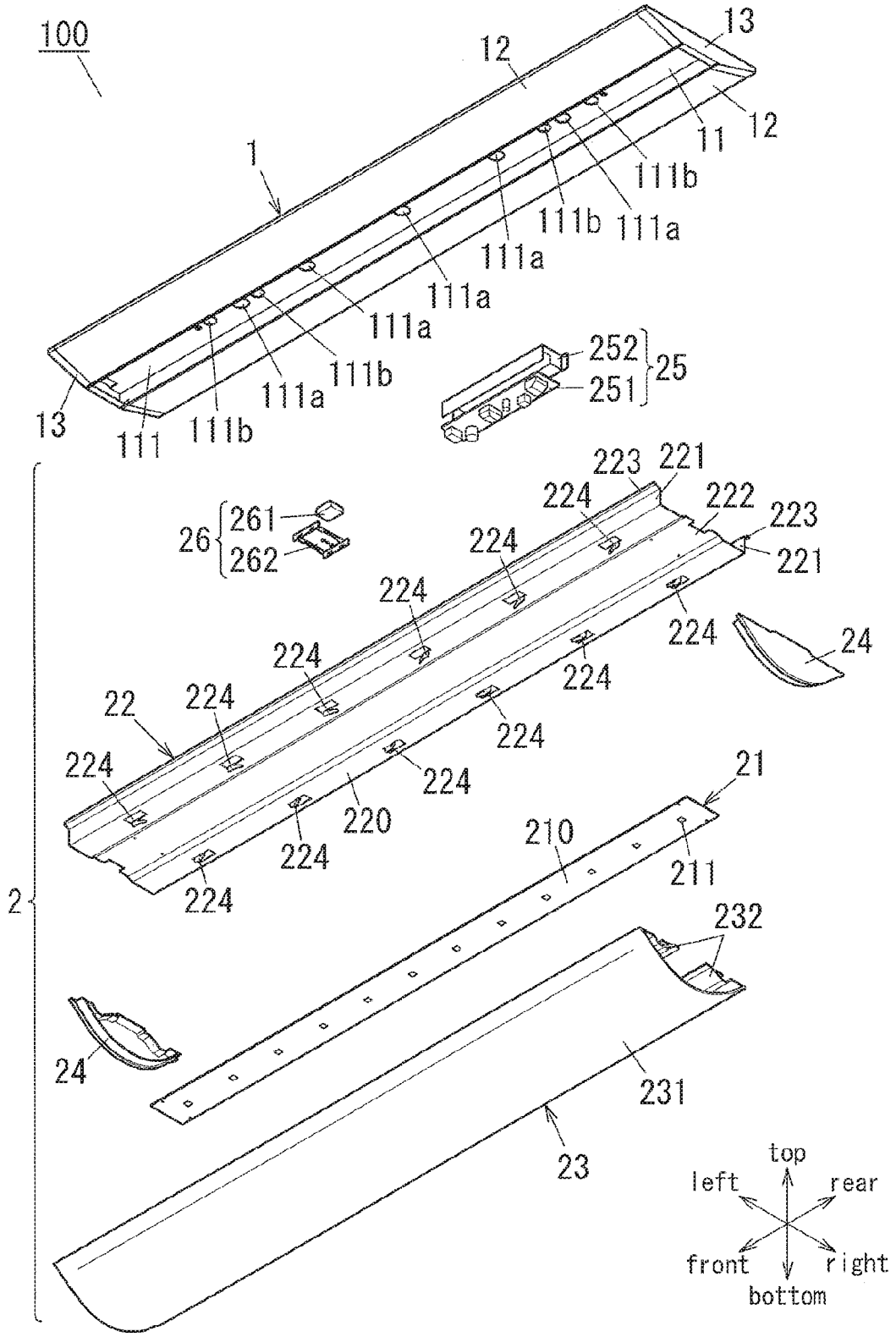
FIG. 1 is an exemplary exploded perspective view of a lighting fixture of an embodiment according to the present disclosure.
Figure 2A:
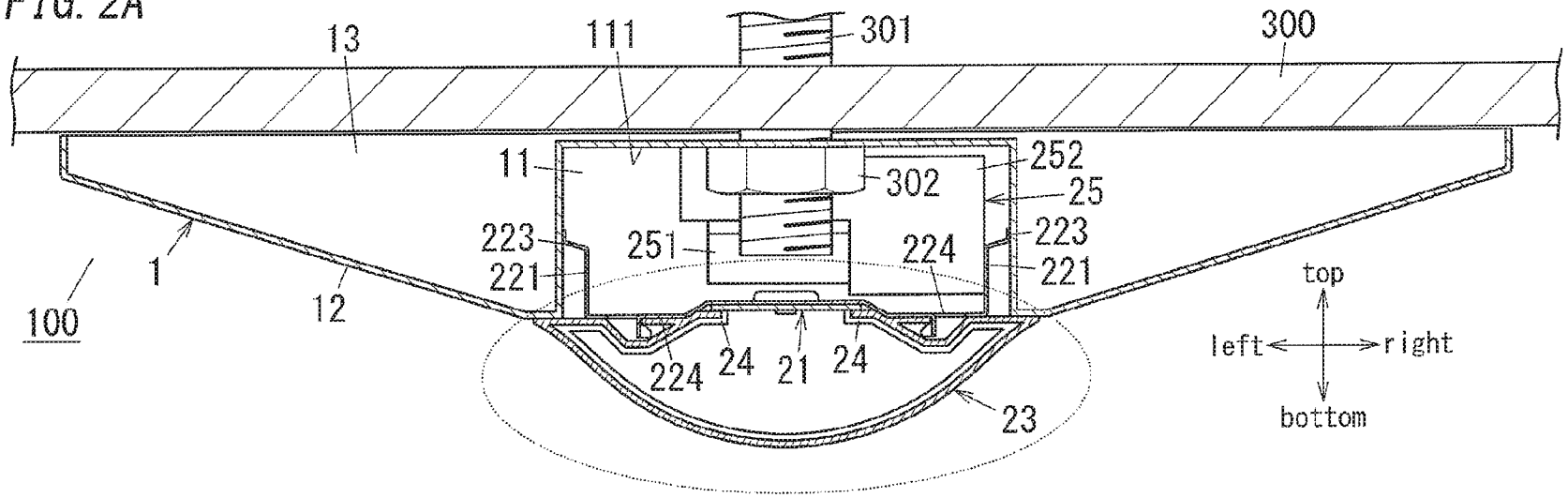
FIG. 2A is a sectional view of the lighting fixture.

As shown in FIG. 1 and FIG. 2A, a lighting fixture 100 of the present embodiment includes a fixture body 1 mounted on a ceiling material 300 (refer to FIG. 2A) and a light source unit 2 detachably attached to the fixture body 1.

The fixture body 1 has a flat box shape which is elongated in the forward and rearward direction and has an opening at an upper surface thereof, and is formed by bending a metal plate. The fixture body 1 includes a recess 11 having a rectangular shape for accommodating the light source unit 2 at a lower side thereof. The recess 11 extends a whole length of the fixture body 1 in the forward and rearward direction. The fixture body 1 further includes a pair of inclined parts 12 on both sides of the recess 11 in the left and right direction. The pair of inclined parts 12 are individually extended from side edges of an opening of the recess 11 so as to incline upward and outward.

As shown in FIG. 1, the recess 11 includes a bottom wall 111, and plural through-holes 111*a* for allowing a passage of an electrical cable are provided in the bottom wall 111 along the forward and rearward direction. Further, plural through-holes 111*b* for allowing a passage of hanger bolts are provided in the bottom wall 111 along the forward and rearward direction. A pair of end caps 13 are individually attached to both ends in the forward and rearward direction of the fixture body 1.

The light source unit 2 includes a light source module 21, an attachment body 22 to which the light source module 21 is attached, a cover 23 covering the light source module 21, and a pair of end covers 24 attached to both ends in the front-rear direction of the cover 23. The light source unit 2 further includes a power source 25 and a terminal block 26.

The light source module 21 includes a circuit board 210 having a rectangular board shape which is elongated in the forward and rearward direction, and plural lighting sources (light-emitting diode) 211 mounted on a lower surface of the circuit board 210 so as to be arranged in the forward and rearward direction. A connector for supplying power is mounted on an end in the forward and rearward direction of the light source module 21 in order to receive electrical power for lighting the lighting sources 211 from the power source 25 through the electrical cable.

Figure 2B:
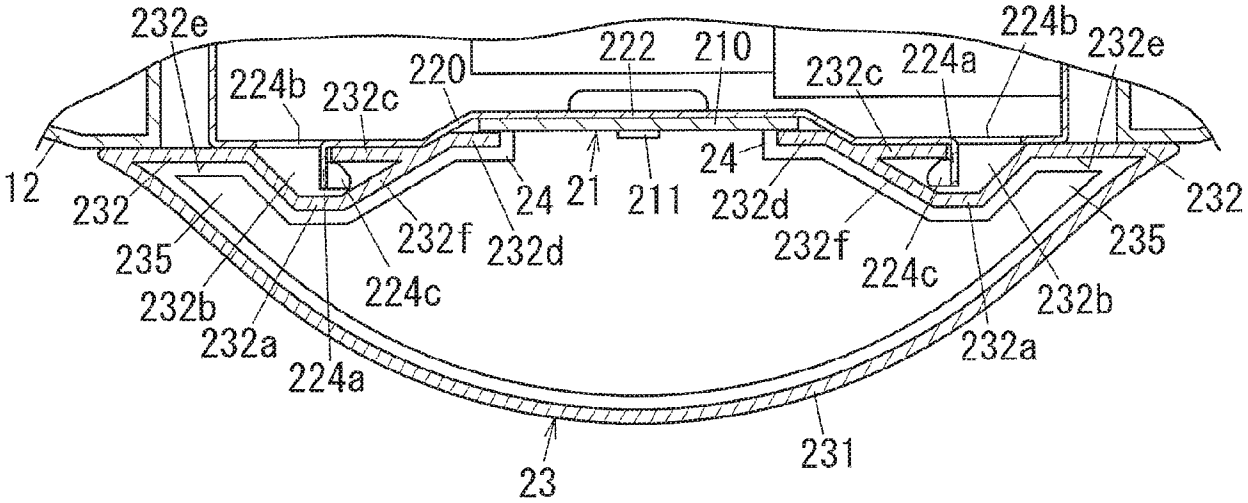
FIG. 2B is an enlarged view of a primary part of the lighting fixture.
Figure 3:
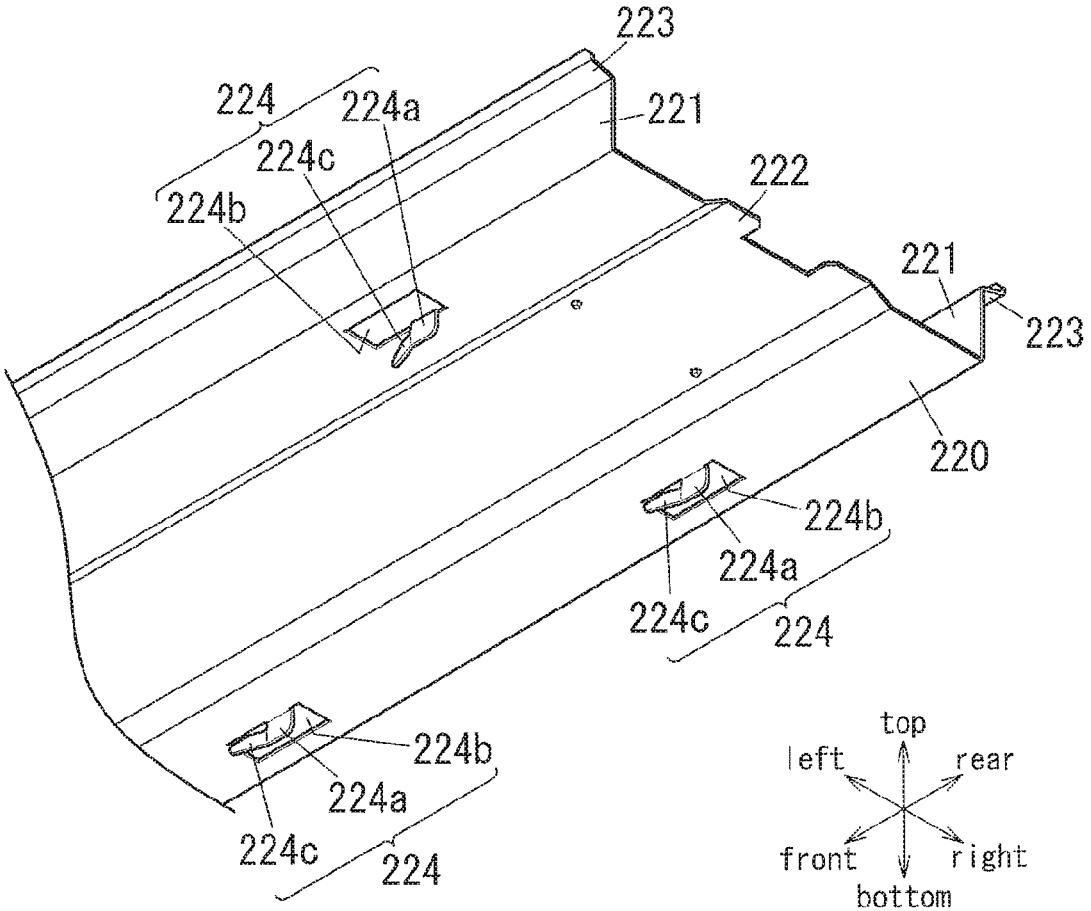
FIG. 3 is a perspective view of a primary part of a light source unit used in the lighting fixture of the embodiment.

The attachment body 22 has a U-shape viewed from the forward and rearward direction and is formed by bending a metal plate, and includes an attachment board 220 having a rectangular board shape which is elongated in the forward and rearward direction, and a pair of side surface parts 221 individually protruding upwardly from both ends in the left and right direction of the attachment board 220 (refer to FIG. 3). As shown in FIG. 2A, each of the pair of side surface parts 221 has a holding part 223 having an L-shape at a tip thereof. As shown in FIG. 2B, the attachment body 22 further includes a recess 222 in a middle in the left and right direction of the attachment board 220. The light source module 21 is accommodated in the recess 222 with the light source module 21 in contact with the recess 222.

As shown in FIG. 2A, FIG. 2B, and FIG. 3, the attachment body 22 further includes plural suspending parts 224 for holding the cover 23. The suspending parts 224 are arranged along a length direction of the attachment body 22 (forward and rearward direction) at both end sides in the left and right direction of the attachment board 220. Each of the plural suspending parts 224 has a cut-and-raised piece 224*a* formed by cutting the attachment body 22 and raising the cut part downward, an opening 224*b* made as a result of cutting and raising the part of the attachment body 22, and a holding piece 224*c* formed by being bent a part of the cur-and-raised piece 224*a* to a side of the lighting sources 211. In other words, the cut-and-raised piece 224*a* is formed by cutting the attachment board 220. The cut-and-raised piece 224*a* is bent to a side of the lighting source 211, and a bent end of the cut-and-raised piece 224*a* serves as the holding piece 224*c*.

As shown in FIG. 2B, the cover 23 includes a panel 231 covering the light source module 21, and a pair of inner flanges 232 each of which has a board shape and which extend from both ends in the left and right direction of the panel 231 to come closer each other.

The panel 231 is made of light diffusion material, such as milky white acrylic resin, and has a box shape which is elongated in the forward and rearward direction and has an opening at an upper surface. Besides, the panel 231 has a convex lens shape in which a center part is positioned more downward than both ends in the left and right direction. In other words, the panel 231 has an arc shape protruding downward viewed from the forward and rearward direction.

Figure 4:
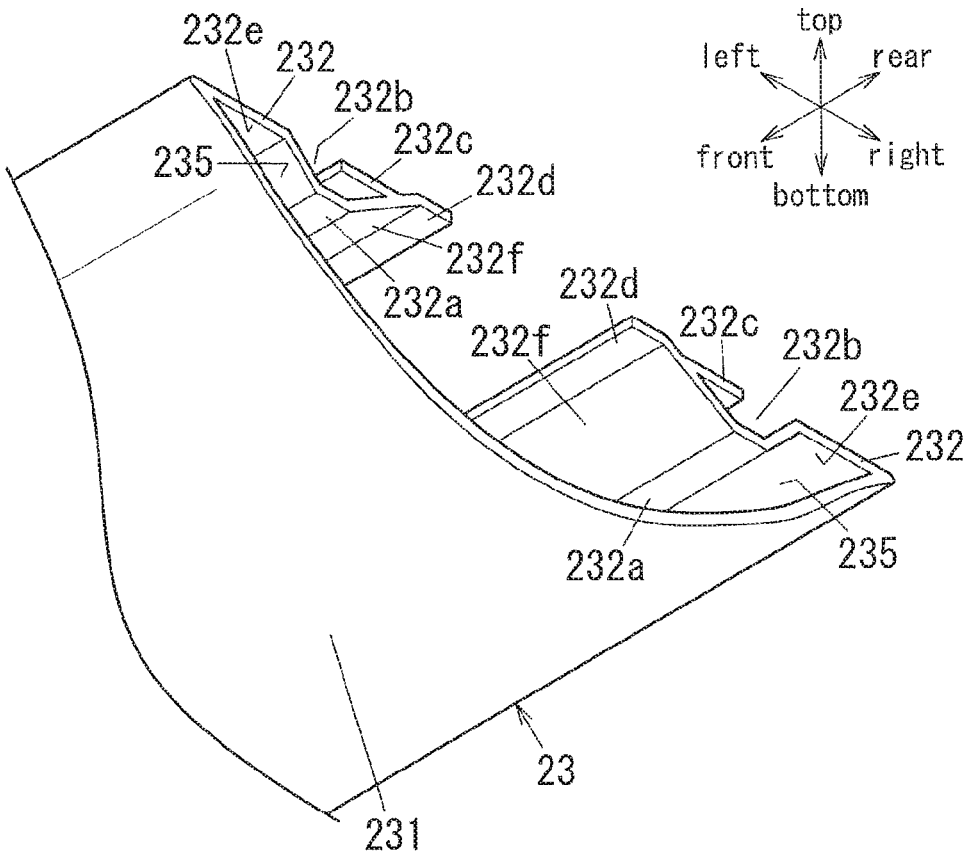
FIG. 4 is a perspective view of another primary part of the light source unit.

As shown in FIG. 2B and FIG. 4, each of the pair of inner flanges 232 is at least partially non-light-transmissive to suppress a transmission of light. Note that, each of the pair of inner flanges 232 may be partially non-light-transmissivity or completely non-light-transmissivity. An inner surface 232*e*, facing the panel 231, of each of the pair of inner flanges 232 is a reflecting surface. Each of the inner flanges 232 has a recess 232*b* and a protruding part 232*a* made as a result of formation of the recess 232*b*. In other words, each of the pair of inner flanges 232 has the protruding part 232*a* curved so as to protrude downward, and the recess 232*b* having an opening in the upper direction is made by forming the protruding 232*a*. Each of the pair of inner flanges 232 further includes an end part 232*d* on an end thereof, and a protruding piece 232*c* extended toward an inside of the recess 232*b* from the end part 232*d* side.

For accommodating the plural suspending parts 224, each of the recesses 232*b* has the opening in an upper direction and has a trapezoidal groove shape which tapers toward a lower surface thereof viewed from the forward and rearward direction. Each of the recesses 232*b* has an inclined part 232*f* connected between the lower surface and the end part 232*d*. Each of the inclined parts 232*f* is a part of the recess 232*b*. The inclined parts 232*f* of the pair of inner flanges 232 face each other in the left and right direction with the lighting sources 211 interposed therebetween. The inclined parts 232*f* are inclined such that distance between the inclined parts 232*f* in the left and right direction of the cover 23 increases with increase in distance from the attachment body 22.

Each of the end parts 232*d* protrudes in the left and right direction from the inclined part 232*f* toward the lighting sources 211. Accordingly, the light source module 21 is held between the attachment board 220 of the attachment body 22 and the end parts 232*d*.

Each of the protruding pieces 232*c* protrudes from an upper end of the inclined part 232*f* toward an inside of the recess 232*b* such that the protruding pieces 232*c* extend toward sides away from each other in the left and right direction. Each of the protruding pieces 232*c* is held between the attachment board 220 and the holing pieces 224*c*.

Note that, an upper surface of each of the protruding pieces 232*c* is in contact with the attachment board 220 when the cover 23 is attached to the attachment body 22. Further, at least part of a portion, from a base end to the recess 232*b*, of each of the pair of inner flanges 232 is in contact with the attachment board 220 when the cover 23 is attached to the attachment body 22.

The cover 23 has, at ends in the left and right direction, a pair of spaces 235 each of which is defined between the protruding part 232*a* and the base end of the inner flange 232 and having a groove shape extending along the forward and rearward direction. Accordingly, each of the pair of spaces 235 allows light emitted from the lighting sources 211 to reach the ends in the left and right direction of the cover 23. In other words, each of the pair of spaces 235 serves as a transmission path of light emitted from the lighting sources 211. Since the light source unit 2 has the spaces 235, the light source unit 2 can more emit light in the left and right direction from the both ends of the cover 23 compared with a light source unit which does not have any spaces 235.

Each of the pair of end covers 24 is made of a light transmissive material, such as acrylic resin, and has a semi-elliptical plate shape. The pair of end covers 24 are attached to ends in the forward and rearward direction of the cover 23, respectably.

The power source 25 includes a circuit board 251 having a rectangular board shape which is elongated in the forward and rearward direction, and a storage case 252 for housing the circuit board 251. At least, circuit components to generate operating power for the lighting source 211, such as a transistor(s), a diode(s), and a capacitor(s), are mounted on the circuit board 251.

The storage case 252 has a rectangular box shape which is elongated in the forward and rearward direction and has an opening at a lower surface thereof. The storage case 252 is attached to the attachment body 22 with screws, for example so that the opening of the storage case 252 faces an upper surface of the attachment board 220 of the attachment body 22.

As shown in FIG. 1, the terminal block 26 includes a terminal table 261 having a rectangular box shape, and a mounting bracket 262 for mounting the terminal table 261 to the attachment body 22. The terminal table 261 is connected to the electrical cables drawn into a room through the ceiling material 300. The terminal block 26 is attached to the attachment body 22 with screws, for example.

A method of assembling of the light source unit 2 is described.

First, an assembler attaches both the power source 25 and the terminal block 26 to the upper surface of the attachment body 22, and connects electrically between the power source 25 and the terminal block 26 with electrical cables. Next, the assembler puts the light source module 21 on the recess 222 of the attachment board 220 of the attachment body 22, places the cover 23 so that the pair of inner flanges 232 abuts onto the attachment board 220 from the lower side of the attachment board 220, so that the light source module 21 is located between the inner flanges 232 of the cover 23 and the attachment board 220. Then, the assembler adjusts the position of the cover 23 so that the plural suspending parts 224 and the recess 232*b* of the inner flanges 232 face each other in the upward and downward direction. The assembler inserts a tool or the like into the opening 224*b* from an upper side of the attachment body 22, and bends the holding piece 224*c* toward the light source module 21 side by the tool, and as a result the protruding pieces 232*c* are hooked on the holding pieces 224*c*. As described above, the cover 23 is attached to the attachment body 22. At that time, the light source module 21 is fixed by being inserted between the end part 232*d* of each of the inner flanges 232 and the attachment board 220. Besides, the assembler connects between the light source module 21 and the power source 25 electrically using the electrical cable. Finally, the assembler attaches the end covers 24 to the both ends of the cover 23 in the forward and rearward direction, respectively.

A method of installing the lighting fixture 100 will be described.

Figure 5:
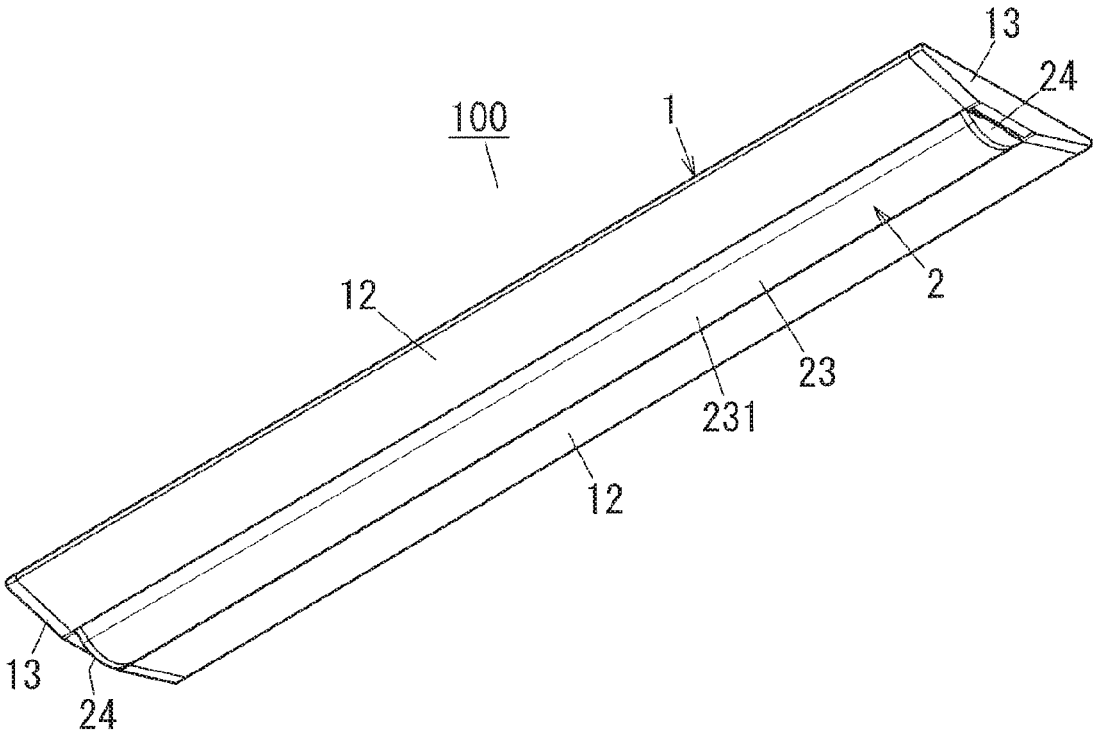
FIG. 5 is a perspective view of the lighting fixture.

First, an installer inserts the electrical cable drawn into the room through the through-hole 111*a* of the fixture body 1. After the installer inserts the plural hanger bolts 301 drawn into the room through the ceiling material 300, through the through-holes 111*b*, the installer attaches the nuts 302 to the hanger bolts 301 individually, thereby fixing the fixture body 1 to the ceiling material 300 (refer to FIG. 2A). Next, the installer connects the electrical cable to the terminal table 261. Finally, the installer attaches the light source unit 2 to the fixture body 1 using, for example, the fitting structure built on the fixture body 1 and the attachment body 22, such as a pair of holding parts 223 hooked on protruding pieces of the recess 11 of the fixture body 1. At that time, the light source unit 2 is attached to the fixture body 1 so that at least the power source 25 and the terminal table 261 are contained in the recess 11 (refer to FIG. 5).

In the light source unit 2 of the present embodiment, the light source module 21 is held between the attachment body 22 and the cover 23. The protruding piece 232*c* and a part of the base end side of each of the inner flanges 232 are in contact with the attachment board 220. Accordingly, the light source unit 2 is formed to block an inside space of the cover 23 from the outside of the cover 23 with the cut-and-raised pieces 224*a* and the holding pieces 224*c* accommodated in the recesses 232*b*. In other words, the protruding pieces 232*c* and the parts of the base end sides of the inner flanges 232 are directly contacted with the attachment board 220 so that the inside space of the cover 23 is isolated from the outside of the cover 23.

In the present embodiment, the light source unit 2 allows that bugs and dusts may enter the recess 232*b* from the outside through the opening 224*b* of the suspending part 224. However, the light source unit 2 is capable of inhibiting bugs and dusts to enter the inside of the cover 23 since the inside of the cover 23 is isolated from the recess 232*b*. Besides, because the inside of the cover 23 is isolated from the recess 232*b*, an installer does not have to put a tape on the opening 224*b* as in the conventional example. Hence, the light source unit 2 and the lighting fixture 100 in the present embodiment are capable of reducing steps of manufacture process.

Note that, each of the plural holding pieces 224*c* is preferably bent at the site which is away from a width side of the light source module 21. Each of the plural holding pieces 224*c* is preferably bent toward the middle in the width direction of the light source module 21. Then, light emitted from the lighting sources 211 toward the plural holding pieces 224*c* can be reflected toward the both end sides of the width (shorter) side of the light source module 21. Therefore, the light source unit 2 is capable of increasing irradiation of light toward the both end sides of the width side of the light source module 21. Especially, when each of the pair of inclined parts 232*f* is not the reflecting surface, the holding pieces 224*c* can reflect light emitted from the light source module 21.

Figure 6:
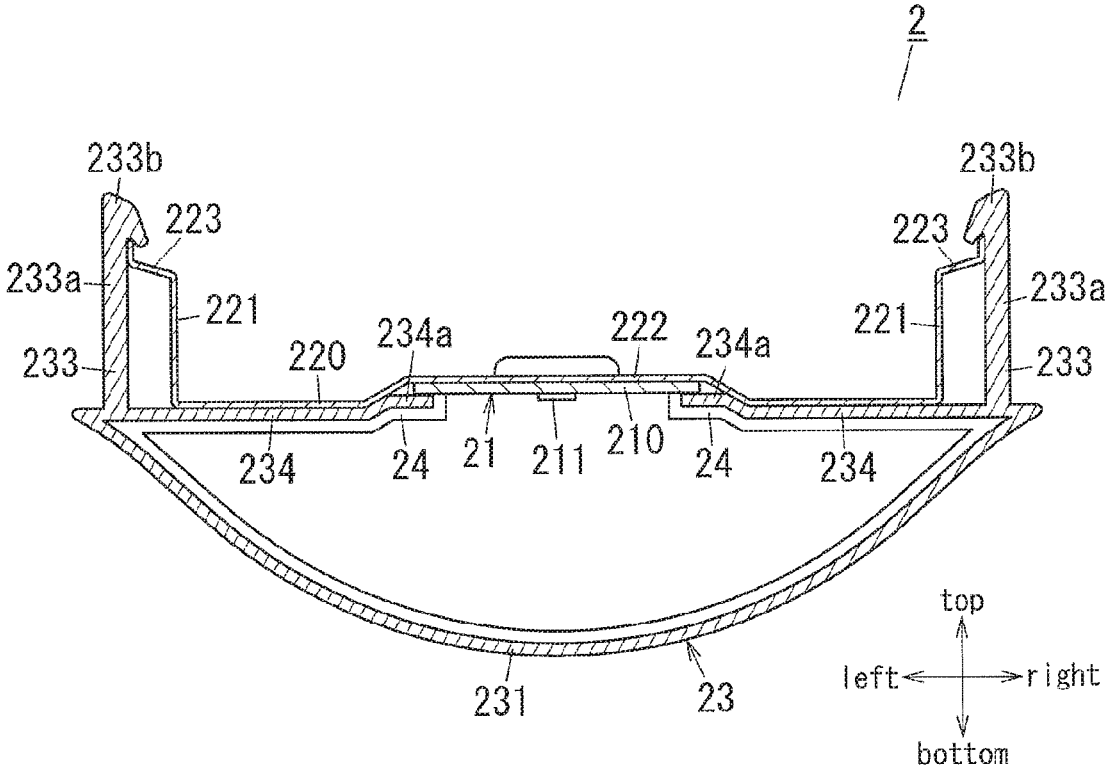
FIG. 6 is a sectional view of a modification of the light source unit.

A modification of a light source unit 2 will be described with reference to FIG. 6.

A light source unit 2 of the modification is different from the light source unit 2 of the embodiment above in that an attachment body 22 does not include any suspending parts 224.

A cover 23 of the light source unit 2 of the modification includes a pair of attachment pieces 233 protruding upward from both end sides in the left and right direction. Each of the pair of attachment pieces 233 includes a leg part 233*a* and a hooking part 233*b* protruding inward from a top of the leg part 233*a*. The cover 23 is attached to the attachment body 22 so that the hooking parts 233*b* of the attachment pieces 233 are suspended on the holding parts 223 of the attachment body 22, respectively.

Note that, because the attachment body 22 does not include any suspending parts 224, the shape of inner flanges 234 of the cover 23 of the modification may have a shape which is different from the shape of the inner flanges 232 of the cover 23 in the embodiment. For example, the inner flanges 234 has only to include a distal end part 234*a* which is formed so as to hold a light source module 21 at the tip along with an attachment board 220. The inner flanges 234 do not have to include the recess 232*b* and the like. Besides, a surface, facing the panel 231, of each of the inner flanges 234 is preferably a reflecting surface which has non-transmissivity.

The cover 23 is fixed to the attachment body 22 by the pair of attachment pieces 233 so that the attachment body 22 does not have any suspending parts 224 in the light source unit 2 of the present modification. The light source unit 2 of the present modification does not include any suspending parts 224 (openings 224*b*), and accordingly is capable of preventing bugs and dusts from entering the inside of the cover 23. Since an installer does not have to tape to the opening 224*b* of the suspending part 224, the light source unit 2 and a lighting fixture 100 in the present modification is capable of reducing the steps of the manufacture process compared with the conventional example.

The attachment body 22 is not necessarily made by a metal plate, and the attachment body 22 may be made by a resin plate. In this case, the attachment body 22 made by a resin plate is preferably fixed to the cover 23 with resin welding to weld upper surfaces of the inner flanges 234 to a lower surface of the attachment board 220 of the attachment body 22. In other words, the attachment body 22 made by a resin plate is fixed to the upper surface of the inner flanges 234 of the cover 23 by heat welding, ultrasonic welding, for example. The attachment body 22 is fixed to the cover 23 by resin welding without using any suspending parts 224. Therefore, the inside of the cover 23 is separated from the outside of the cover 23. As the result, the light source unit 2 is capable of suppressing the bugs and dusts to enter the inside of the cover 23 from the outside of the cover 23.

The pair of end covers 24 do not have to be attached to the cover 23 at the end of the manufacture (assembling) process. For example, one of the pair of end covers 24 may be attached to the cover 23, the light source module 21 is inserted between the cover 23 and the attachment body 22 with the end cover 24 attached to the cover 23, then the other end cover 24 may be attached to the cover 23. Besides, for example, the cover 23 may be integrally formed with the end covers 24.

The attachment body 22 may have dowels and the circuit board 210 may have holes so that the light source module 21 does not move in the forward and rearward direction with respect to the recess 222. The light source module 21 may be fixed to the attachment body 22 by inserting dowels into the holes of the circuit board 210. Plural light source units 2 may be arranged in the forward and rearward direction to be attached to a single fixture body 1.

The light source unit 2 of the embodiment may include the cover 23 having the attachment pieces 233 as the modification described above. In other words, the cover 23 of the embodiment may include both the suspending parts 224 and the attachment pieces 233 and is fixed to the attachment body 22 with them.

As described above, a light source unit 2 of one aspect of the present disclosure includes a circuit board 210 having a surface (lower surface) on which lighting sources 211 are mounted; and an attachment body 22 having an elongated shape and including an attachment board 220 to which the other surface (upper surface) of the circuit board 210 is attached in a contact manner. The light source unit 2 further includes a cover 23 having an elongated shape and attached to the attachment board 220 of the attachment body 22 so as to cover the surface (lower surface) side of the circuit board 210 with a length direction thereof being in parallel to a length direction of the attachment body 22. The cover 23 includes a panel 231 having an elongated shape and covering the circuit board 210, and a pair of inner flanges 232 having a board shape and extending from both ends of the panel 231 in a width direction (left and right direction) of the panel 231 so as to come toward each other. The circuit board 210 is supported by being held between the pair of inner flanges 232 and the attachment board 220 of the attachment body 22.

In other words, a light source unit 2 of one aspect of the present disclosure includes an attachment body 22 having an elongated shape, which has a longer side in a length direction and a shorter side in a width direction shorter than the longer side, and including an attachment board 220; a circuit board 210 having a first surface in contact with the attachment board 220 and a second surface on which lighting sources 211 are mounted. The light source unit 2 further includes a cover 23 having an elongated shape, which has a longer side in a length direction and a shorter side in a width direction shorter than the longer side, and attached to the attachment body 22 so as to cover the second surface of the circuit board 210 with the length direction (forward and rearward direction) of the cover 23 being in parallel to the length direction of the attachment body 22. The cover 23 includes a panel 231 having an elongated shape, which has a longer side in a length direction and a shorter side in a width direction shorter than the longer side, and covering the circuit board 210, and a pair of inner flanges 232 each of which has a board shape and which extend from both ends of the panel 231 in the width direction (left and right direction) of the panel 231 so as to come toward each other. The circuit board 210 is supported by being held between the pair of inner flanges 232 and the attachment board 220 of the attachment body 22.

The light source unit 2 of the aspect is configured as described above to reduce steps of manufacture process and prevent dusts, bugs, and others from entering the inside of the cover 23.

In the light source unit 2 of one aspect of the present disclosure, the attachment body 22 is preferably made by a metal plate and preferably includes plural suspending parts 224 which are arranged along the length direction (forward and rearward direction) on both sides in a width direction (left and right direction). Each of the plural suspending parts 224 preferably includes a cut-and-raised piece 224*a* cut and raised toward a side of the cover 23, an opening 224*b* by being cut and raised the attachment body 22, and a holding piece 224*c* by bending a part of the cut-and-raised piece 224*a* toward a side of the lighting sources 211. Each of the pair of inner flanges 232 preferably includes a recess 232*b* for housing the plural suspending parts 224, and a protruding piece 232*c* extended from an edge of an opening 224*b* of the recess 232*b* toward an inside of the recess 232*b*. The attachment body 22 preferably, supports the cover 23 by holding the protruding pieces 232*c* each between the holding pieces 224*c* and the attachment board 220.

In other words, in the light source unit 2 of one aspect of the present disclosure, each of the pair of inner flanges 232 preferably includes a recess 232*b* with an opening 224*b* which is recessed so as to be away from the attachment body 22 and a protruding piece 232*c* which is extended from an edge of the opening 224*b* of the recess 232*b* toward an inside of the recess 232*b*. The attachment body 22 is preferably made by a metal plate and includes plural suspending parts 224 which are arranged along the length direction (forward and rearward direction) on each side in the width direction (left and right direction) of the attachment body 22 and housed in the recess 232*b*. Each of the plural suspending parts 224 preferably includes a cut-and-raised piece 224*a* which is cut and raised a part of the attachment body 22 toward a side of the cover 23, and a holding piece 224*c* formed by a part of the cut-and-raised piece 224*a* that is bend to a side of the lighting sources 211 and extended toward the lighting sources 211. The attachment body 22 preferably supports the cover 23 by holding the protruding pieces 232*c* each between the holding pieces 224*c* of the plural suspending parts 224 and the attachment board 220.

When the light source unit 2 of the aspect is configured as described above, it is possible to prevent dusts, bugs, and others from entering the inside of the cover 23 through the openings 224*b* of the plural suspending parts 224.

In the light source unit 2 of one aspect of the present disclosure, parts, facing each other in the width direction (left and right direction) of the cover 23, of the recesses 232*b* of the pair of the inner flanges 232 are preferably formed into inclined parts 232*f* so as to incline far away from the attachment body 22 with getting far each other away in the width direction. The inclined parts 232*f* are preferably reflection surfaces to reflect the light emitted from the lighting sources 211.

In other words, in the light source unit 2 of one aspect of the present disclosure, the recess 232*b* of each of the inner flanges 232 preferably has an inclined part 232*f*, the inclined parts 232*f* of the recesses 232*b* of the inner flanges 232 facing each other in the width direction (left and right direction) of the cover 23. The inclined parts 232*f* are inclined so as to be away from each other with an increase in distance from the attachment body 22. Each of the inclined parts 232*f* has a reflection surface to reflect light emitted from the lighting sources 211.

When the light source unit 2 of the aspect is configured as described above, the light source unit 2 is capable of reducing the steps of the manufacture process, since a step of coating reflection metal to the attachment body 22 can be omitted.

In the light source unit 2 of one aspect of the present disclosure, each of the pair of inner flanges 232 preferably includes a protruding part 232*a* which is disposed on a back side of the recess 232*b* and protrudes toward the panel 231. The light source unit 2 preferably includes a space 235 as a transmission path that is formed between the protruding part 232*a* and an inside surface of the panel 231 so as to allow the light emitted from the lighting sources 211 traveling in the width direction (left and right direction) of the cover 23.

When the light source unit 2 of the aspect is configured as described above, the light source unit 2 is capable of emitting light from the lighting sources 211 more widespread.

In the light source unit 2 of one aspect of the present disclosure, the cover 23 further preferably includes attachment pieces 233 protruding from the both ends in the width direction (left and right direction) of the panel 231, respectively. The attachment body 22 further preferably includes holding parts 223 on both ends in the width direction of the attachment body 22, respectively. The cover 23 is preferably attached to the attachment body 22 by the attachment pieces 233 suspended on the holding parts 223, respectively.

When the light source unit 2 of the aspect is configured as described above, the light source unit 2 is capable of reducing the steps of the manufacture process.

In the light source unit 2 of one aspect of the present disclosure, a surface (inner surface 232*e*), facing the panel 231, of each of the pair of inner flanges (232, 234) of the cover 23 is preferably a reflecting surface.

When the light source unit 2 of the aspect is configured as described above, the light source unit 2 is capable of emitting light from the lighting sources 211 more efficiently and decreasing costs since a number of the lighting sources 211 can be reduced.

In the light source unit 2 of one aspect of the present disclosure, the attachment body 22 is preferably made by resin and preferably fixed to the cover 23 by resin welding.

When the light source unit 2 of the aspect is configured as described above, the light source unit 2 is capable of preventing bugs and dusts from entering the inside of the cover 23 from the outside, since the cover 23 is fixed through the resin welding.

A lighting fixture 100 of one aspect of the present disclosure includes the light source unit 2 and a fixture body 1 to which the light source unit 2 is to be attached.

The lighting fixture 100 of the aspect is configured as described above to reduce steps of manufacture process and prevent dusts, bugs, and others from entering the inside of the cover 23.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A light source unit comprising:

an attachment body having an elongated shape, which has a longer side in a length direction and a shorter side in a width direction shorter than the longer side, and including an attachment board;

a circuit board having a first surface in contact with the attachment board and a second surface on which lighting sources are mounted; and a cover having an elongated shape, which has a longer side in a length direction and a shorter side in a width direction shorter than the longer side, and attached to the attachment body so as to cover the second surface of the circuit board, with the length direction of the cover being in parallel to the length direction of the attachment body, wherein:

the cover includes:

a panel having an elongated shape, which has a longer side in a length direction and a shorter side in a width direction shorter than the longer side, and covering the circuit board; and a pair of inner flanges each of which has a board shape and which extend from both ends of the panel in the width direction of the panel so as to come toward each other, the circuit board is supported by being held between the pair of inner flanges and the attachment board of the attachment body, each of the pair of inner flanges includes a recess with an opening which is recessed so as to be away from the attachment body and a protruding piece which is extended from an edge of the opening of the recess toward inside the recess, the attachment body is made by a metal plate and includes plural suspending parts which are arranged along the length direction on each side in the width direction of the attachment body and housed in the recess, each of the plural suspending parts includes:

a cut-and-raised piece which is cut and raised from the attachment body toward a side of the cover; and a holding piece formed by a part of the cut-and-raised piece that is bent to a side of the lighting sources and extended toward the lighting sources, and the attachment body supports the cover by holding the protruding pieces each between the holding piece of each of the plural suspending parts and the attachment board.

2. The light source unit according to claim 1, wherein:

the recess of each of the inner flanges has an inclined part, the inclined parts of the recesses of the inner flanges facing each other in the width direction of the cover, the inclined parts are inclined so as to be away from each other with an increase in distance from the attachment body, and each of the inclined parts has a reflection surface to reflect light emitted from the lighting sources.

3. The light source unit according to claim 1, wherein:

each of the pair of inner flanges includes a protruding part which is disposed on a back side of the recess and protrudes toward the panel, and a space as a transmission path is formed between the protruding part and an inside surface of the panel so as to allow light emitted from the lighting sources traveling in the width direction of the cover.

4. The light source unit according to claim 2, wherein:

each of the pair of inner flanges includes a protruding part which is disposed on a back side of the recess and protrudes toward the panel, and a space as a transmission path is formed between the protruding part and an inside surface of the panel so as to allow light emitted from the lighting sources traveling in the width direction of the cover.

5. The light source unit according to claim 1, wherein:

the cover further includes attachment pieces protruding from the both ends in the width direction of the panel, respectively, the attachment body further includes holding parts on both ends in the width direction of the attachment body, respectively, and the cover is attached to the attachment body by the attachment pieces suspended on the holding parts, respectively.

6. The light source unit according to claim 2, wherein:

the cover further includes attachment pieces protruding from the both ends in the width direction of the panel, respectively, the attachment body further includes holding parts on both ends in the width direction of the attachment body, respectively, and the cover is attached to the attachment body by the attachment pieces suspended on the holding parts, respectively.

7. The light source unit according to claim 4, wherein:

the cover further includes attachment pieces protruding from the both ends in the width direction of the panel, respectively, the attachment body further includes holding parts on both ends in the width direction of the attachment body, respectively, and the cover is attached to the attachment body by the attachment pieces suspended on the holding parts, respectively.

8. The light source unit according to claim 1, wherein:

a surface, facing the panel, of each of the pair of inner flanges of the cover is a reflecting surface.

9. The light source unit according to claim 2, wherein:

a surface, facing the panel, of each of the pair of inner flanges of the cover is a reflecting surface.

10. The light source unit according to claim 5, wherein:

a surface, facing the panel, of each of the pair of inner flanges of the cover is a reflecting surface.

11. The light source unit according to claim 7, wherein:

a surface, facing the panel, of each of the pair of inner flanges of the cover is a reflecting surface.

12. The light source unit according to claim 1, wherein the attachment body is made by resin and fixed to the cover by resin welding.

13. The light source unit according to claim 5, wherein the attachment body is made by resin and fixed to the cover by resin welding.

14. The light source unit according to claim 8, wherein the attachment body is made by resin and fixed to the cover by resin welding.

15. A lighting fixture comprising:

the light source unit according to claim 1; and a fixture body to which the light source unit is to be attached.

16. A light source unit comprising:

an attachment body having an elongated shape, which has a longer side in a length direction and a shorter side in a width direction shorter than the longer side, and including an attachment board;

a circuit board having a first surface in contact with the attachment board and a second surface on which lighting sources are mounted; and a cover having an elongated shape, which has a longer side in a length direction and a shorter side in a width direction shorter than the longer side, and attached to the attachment body so as to cover the second surface of the circuit board, with the length direction of the cover being in parallel to the length direction of the attachment body, wherein:

the cover includes:

a panel having an elongated shape, which has a longer side in a length direction and a shorter side in a width direction shorter than the longer side, and covering the circuit board; and a pair of inner flanges each of which has a board shape and which extend from both ends of the panel in the width direction of the panel so as to come toward each other, the circuit board is supported by being held between the pair of inner flanges and the attachment board of the attachment body, the cover further includes attachment pieces protruding from the both ends in the width direction of the panel, respectively, the attachment body further includes:

side surface parts protruding from both ends in the width direction of the attachment board so as to be away from the panel, and holding parts provided on ends of the side surface parts, respectively, and the cover is attached to the attachment body by the attachment pieces suspended on the holding parts, respectively.

* * * * *